United States Patent [19]

Hudson et al.

[11] Patent Number: 4,667,712

[45] Date of Patent: May 26, 1987

[54] LOG SPLITTER

[76] Inventors: Charles L. Hudson, Rte. 5, Box 322-A; David R. Hudson, P.O. Box 363; Kenneth E. Burkhalter, Rte. 4, Box 135-A, all of Gordo, Ala. 35466

[21] Appl. No.: 842,986

[22] Filed: Mar. 24, 1986

[51] Int. Cl.[4] ..... B27L 7/00

[52] U.S. Cl. ..... 144/193 A; 144/366; 280/727

[58] Field of Search ..... 144/193 R, 3 K, 193 A, 144/193 K, 366; 280/727

[56] References Cited

U.S. PATENT DOCUMENTS 4,081,008 3/1978 Dilling ..... 144/193 A 4,503,894 3/1985 Gratowski ..... 144/193 A

*Primary Examiner*—W. D. Bray

*Attorney, Agent, or Firm*—C. A. Phillips

[57] ABSTRACT

A log splitter in which a log splitter beam is rotatably attached to a rear upright frame of a wood transporting trailer. The beam is rotatable between a vertical position which is maintainable for splitting operation and a diagonal position where it is secured during over-the-road operation of the trailer.

5 Claims, 10 Drawing Figures

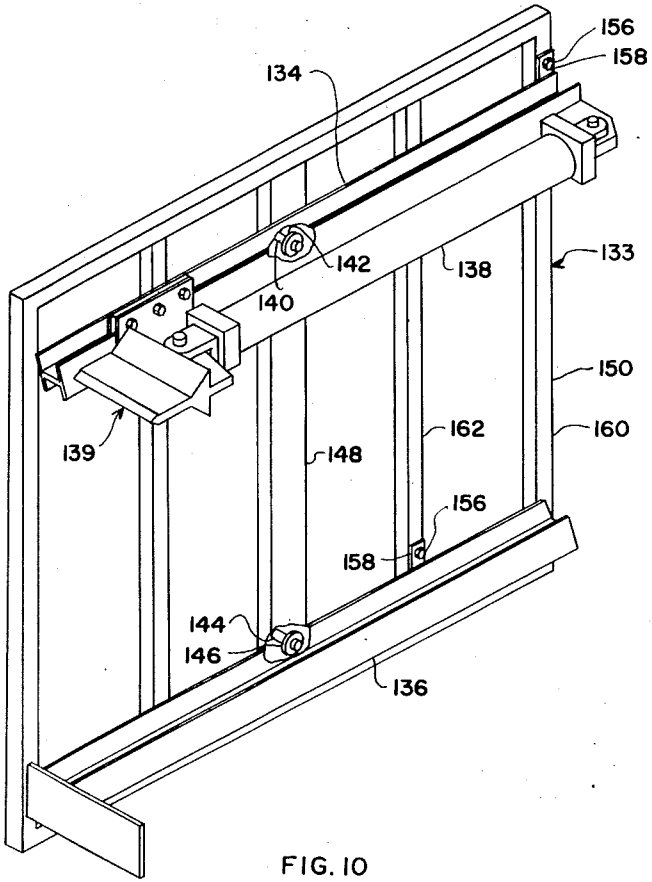
FIG. 10
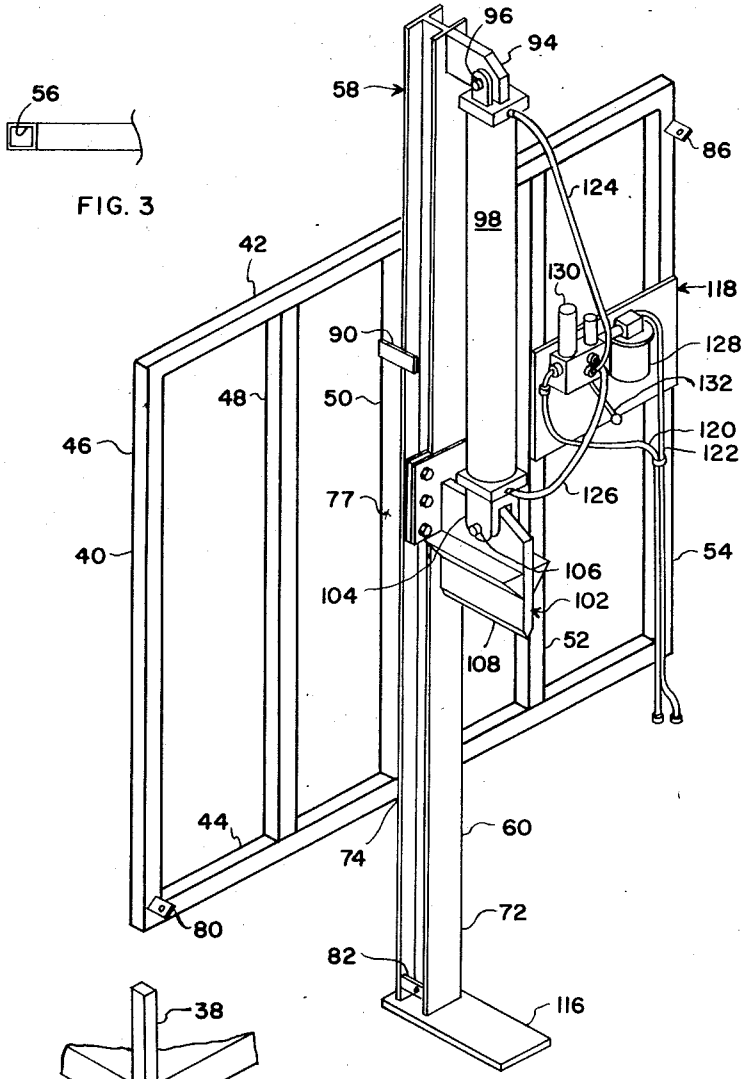
FIG. 3
FIG. 2

LOG SPLITTER

FIELD OF THE INVENTION

This invention relates generally to powered log splitters and, more particularly, to log splitting devices mounted on a frame in such a manner that it can be easily changed between a vertical operating position and a storage position.

BACKGROUND OF THE INVENTION

With the tremendous growth in popularity of wood-burning stoves, the consumption and demand for wood as fuel has increased dramatically. The increase in demand has increased the competition among purchasers of wood supplies, and, in doing so, has forced the price of wood up. To reduce costs, many consumers have turned to their own resources for the harvesting and acquisition of wood, and as a result, a market is developing for economical, practical, and easily transportable wood harvesting equipment.

Generally, the use of wood as fuel necessitates cutting and splitting logs to dimensions which can be accommodated by a stove. Usually, a tree is cut into convenient lengths at the location where it is felled, and it is then loaded and transported to another location where it is unloaded, split, and used or reloaded for distribution. The process of loading and unloading heavy unsplit logs to carry out the wood splitting step significantly adds to the burden and expense of the wood gathering operation. If the wood could be split at the location where the tree is felled, a great deal of this effort and expense would be eliminated.

The easiest method of splitting wood involves the use of powered splitters. Typically, they are constructed with a splitting wedge and a power ramming device mounted on a beam along with a log support. Because of the tremendous forces involved and because of the ram length necessary to accommodate lengthwise splitting of logs, most power log splitters are fairly long and heavy. In most cases, the length and weight dictate operation of the splitter in a horizontal position. While this facilitates transportation to the location where wood is to be cut, it has the disadvantage of requiring that log sections to be split be totally picked up and placed horizontally in the splitter. Ideally, a splitter would be mobile and yet be operable in a vertical position so that the entire log section does not have to be lifted; it need only be rotated on one end onto an end support of the splitter. To this goal, various designs have been proposed that provide for raising the log splitter into the vertical position either manually or by some sort of power assist. Unfortunately, this convenience has come at the expense of added bulk, complexity, and cost.

A need exists for an economical and efficient log splitter which is easily maneuvered between a vertical operating position and an angular offset position for transporting it.

Accordingly, an object of this invention is to provide a heavy duty, uncomplicated, and inexpensive log splitter which is easily transportable in a storage mode but can be quickly and simply transformed into a operating mode for splitting.

SUMMARY OF THE INVENTION

In accordance with this invention, a hydraulically operated wedge is slidably affixed to a beam structure, and the beam structure is pivotally attached to a vertical frame which removably forms an end support of a wood transporting trailer.

BRIEF DESCRIPTION OF THE DRAWINGS

FIG. 2 is a perspective view particularly illustrating a single beam embodiment of the invention.

FIG. 3 is a sectional view taken along line 3—3 of FIG. 2.

FIG. 10 is a partial perspective view of the embodiment shown in FIG. 8 (the hydraulic system is omitted) and illustrating the log splitter in a transport or stowed position.

DETAILED DESCRIPTION OF THE DRAWINGS

Figure 1:
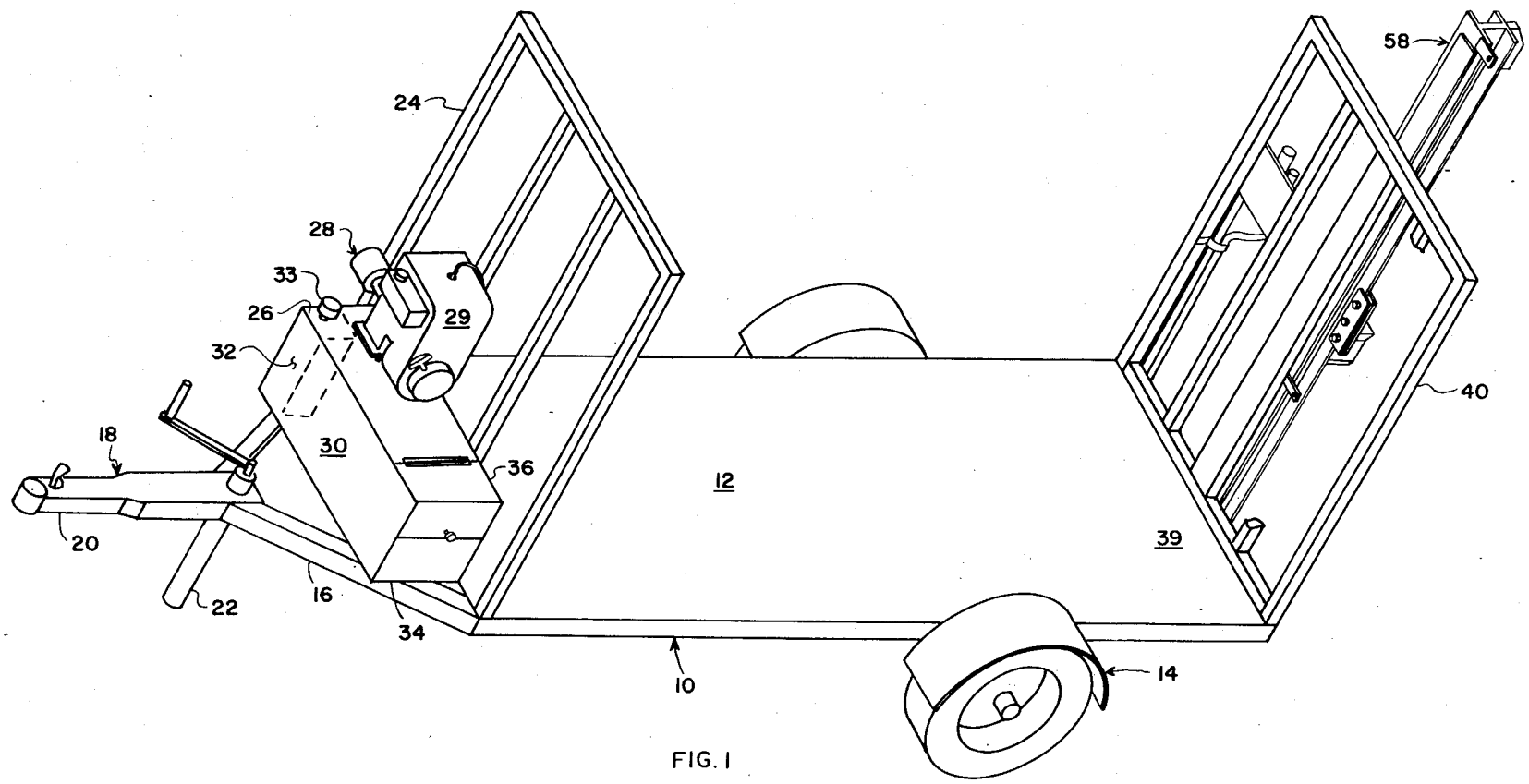
FIG. 1 is a perspective view of a log splitting assembly embodying the present invention.
Figure 7:
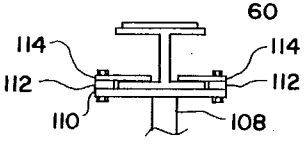
FIG. 7 is a sectional view taken along line 7—7 of FIG. 2.

Referring initially to FIGS. 1–7, trailer assembly 10 includes a rectangular bed 12 mounted on a conventional wheel assembly 14 (FIG. 1). A triangular frame 16 extends from the front of the bed, and it converges at tongue assembly 18, which is comprised of hitch assembly 20 and conventional crank-operated stand 22. A vertical frame 24 is attached along the front of the bed, and it supports platform 26 upon which is mounted a conventional gasoline-powered hydraulic pump 28 and gasoline tank 29. A storage box 30 is mounted on frame 24, and it includes a vented hydraulic fluid reservoir 32, having a vent 33, for supplying hydraulic fluid to powered pump assembly 28 and a tool compartment 34 enclosable by a lid 36.

Vertical mounting posts 38 (only one being shown in FIG. 2) are mounted on the rear end 39 of bed 12, and these posts vertically support and facilitate the installation and removal of frame 40. Frame 40 consists of upper and lower parallel frame members 42 and 44 between which are positioned spaced vertical members 46, 48, 52, and 54. Outside vertical frame members 46 and 54 have hollow openings 56 (only one being shown in FIG. 3) which securely fit over mounting posts 38 of trailer 10 to effect the removable attachment of frame 40 and thereby splitting assembly 58.

Figure 5:
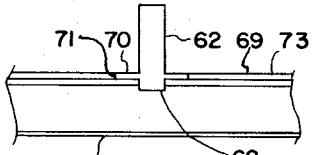
FIG. 5 is a sectional view taken along line 5—5 of FIG. 4.

Splitting assembly 58 (FIG. 2) employs "H" beam 60 which is pivotally supported (FIGS. 4 and 5) on vertical member 50 by beam pin 62 through an opening 64 in vertical member 50 of frame 40. Pin 62 is configured as shown in FIG. 5, with a region 68 being countersunk and welded in beam 60. A larger collar region 70 serves to strengthen pin 62. Shim strip 69 is attached along the length of beam 60 as shown. Opening 71 is provided in shim strip 69 to accommodate the projection of pin 62 and collar region 70. Pin collar 70 has a thickness that is less than or equal to the thickness of shim strip 69 so that shim surface 73 will evenly or flushly contact the facing of vertical frame member 50 when beam 60 is in the vertical operating position. This helps to prevent contact points of high pressure between shim surface 73 and frame member 50 and thus minimizes their wear.

Figure 6:
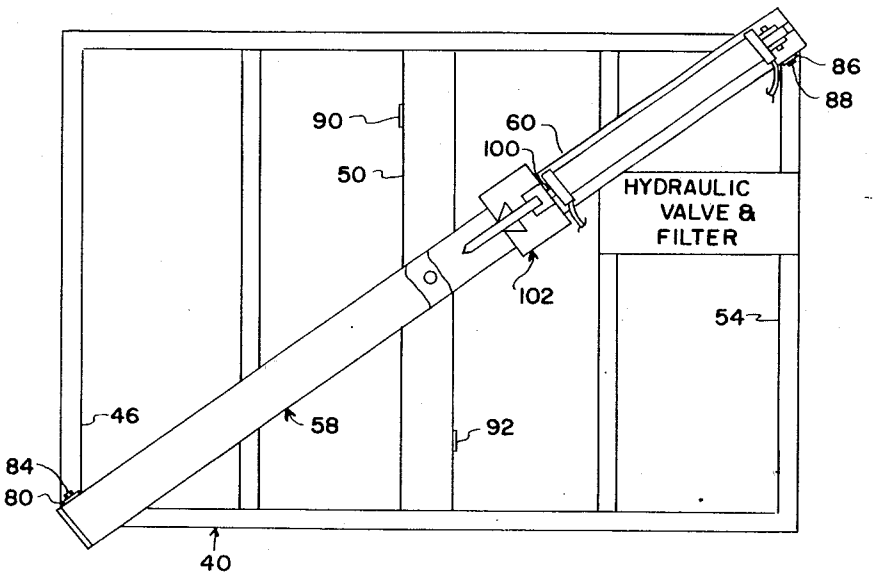
FIG. 6 is a front view of the frame and single beam log splitter in a stowed or storage position.

Opening 64 in vertical frame member 50 is at the approximate geometric center of this frame member, and the length of "H" beam 60 is such that with bed 12 level, end 72 of beam 60 would be approximately one or two inches above level ground. This, the distance from bed level point 74 on "H" beam 60 to the end 72 of beam 60 would be the height of bed 12 at wheel assembly 14, less one or two inches. This distance plus the distance form point 74 to center point 77 would define the length of beam 60 from pin 62 to end 72, or half the length of beam 60. FIG. 6 illustrates splitter assembly 58 in a stowed position wherein beam 60 is diagonally positioned. The beam is secured in this position using frame tab 80, beam nut plate 82, and bolt 84 on the lower end of beam 60, and frame tab 86, a beam nut plate (not shown), and bolt 88 on the upper end of beam 60 (FIGS. 2 and 6). Frame tab 80 is attached to vertical frame member 46 as shown. It has a flat mating surface which is angled such that is will flushly contact the surface of beam nut plate 82 which is attached to the side of beam 60 as shown. Bolt 84 inserts through an opening in tab 80 and threads into nut plate 82 to threadably secure the lower end of beam 60 in a diagonal position. In the same fashion, frame tab 86 mounted to vertical frame member 54 in conjunction with a beam nut plate (not shown) and bolt 88 secure the upper end of beam 60 in a diagonal storage position. In this position, its lateral dimensions are generally confined with in the overall width of trailer 10, including its wheels.

Frame stops 90 and 92 are attached to frame assembly 40 at the top and bottom of vertical frame member 50 (FIGS. 2 and 6) to prevent beam 60 from rotating past a vertical operating position when rotated from a diagonal storage position.

Referring now to FIG. 2, bracket 94, mounted on beam 60, and pin 96 pivotally support double acting hydraulic cylinder 98 at one end, which cylinder is positioned longitudinally along the beam. Piston rod 100 (FIG. 6) protrudes from the other end of the cylinder, and it is pivotally attached to wedge assembly 102 (FIG. 2) by hinge 104 and pin 106. Splitting wedge 108 (FIG. 7) is welded to plate 110, and plate 110 is bolted through spacer plates 112 to flange plates 114 on each side of "H" beam 60 to slidably secure the wedge to the beam. Anvil 116 (FIG. 2) is attached at end 72 of beam 60 to provide a wood stop or stand for wood splitting operations.

A hydraulic control assembly 118 (FIG. 2) includes hydraulic fluid lines 120, 122, 124, and 126, a filter 128, a three-position (two-way) valve 130, and control lever 132, these being mounted on frame 40, as shown in FIG. 2. Hydraulic fluid is supplied through hydraulic line 120 from pump assembly 28 to hydraulic control assembly 118 to operate hydraulic cylinder 98.

To begin operation, "H" beam 60 is first rotated from a diagonal or sloped position as shown in FIG. 6 to a vertical position with anvil 116 down, as shown in FIG. 2. Stops 90 and 92 stop beam 60 at a vertical position. A log to be split is then placed with one end down on anvil 116 lengthwise to the beam. Control lever 132 is then moved to a first position to operate valve 130 to apply pressurized hydraulic fluid through line 126 (fluid returns through line 122) to enter the top of hydraulic cylinder 98, thereby extending piston rod 100 and forcing wedge assembly 102 along the beam into the log to be split. After it is split, control lever 132 is moved to a second position, and pressurized fluid is directed through line 126 (fluid returns through line 124 to the lower end of hydraulic cylinder 98, thereby forcing rod 100 to retract and return wedge assembly 102 to its original position, whereupon the process would be repeated. Split logs would be loaded on trailer bed 12.

At the completion of log splitting activities, the apparatus is readied for transport or storage. To accomplish this, beam 60 is rotated until it is aligned with a diagonal of frame 40 (FIG. 6). The upper portion of beam 60 is then secured using bolt 88 inserted through tab 86 and threadably secured into a beam nut plate (not shown). The lower portion is secured using bolt 84 inserted through tab 80 and threadably secured into nut plate 82. In this position, the log splitter is raised significantly above ground but has no significant protrusions to the side and may be conveniently transported along with the split logs.

Figure 9:
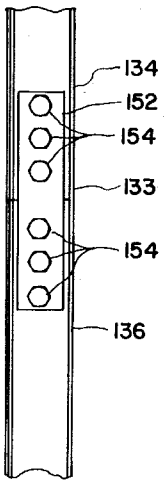
FIG. 9 is a side view of the beam members of the embodiment illustrated in FIG. 8, particularly illustrating their attachment when in an operating mode.
Figure 4:
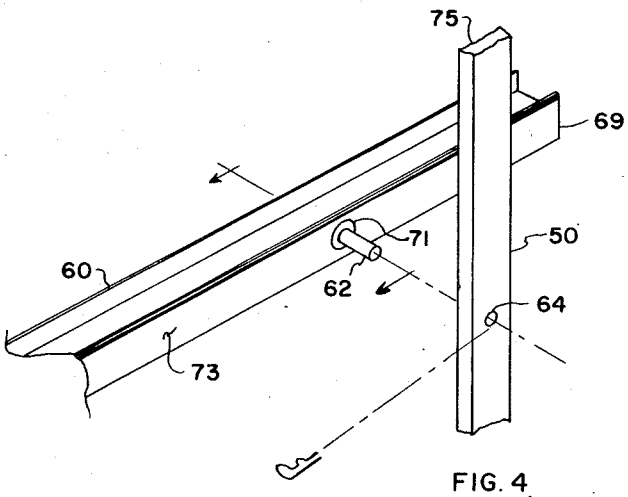
FIG. 4 is an isolated view of a beam pivoting pin and vertical frame member opening as seen from a reverse perspective from that of FIG. 2.
Figure 8:
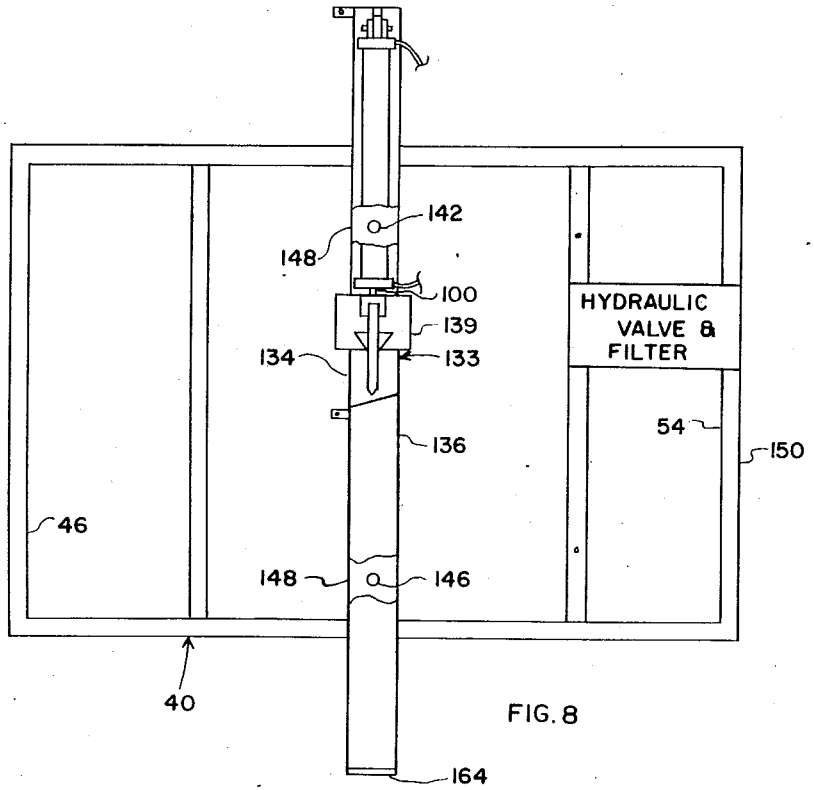
FIG. 8 is a front view of an alternate embodiment of the invention, in this case, employing two beam members and illustrating attachment to a frame when in an operating position.

A second embodiment of this invention is illustrated in FIGS. 8–10. In it, splitting assembly 133 employs two approximately equal length "H" beam sections 134 and 136 are substituted for beam 60 (FIG. 2). Thus, together beam sections 134 and 136 provide support for cylinder 138 and a guide or track for the movement of wedge assembly 139. Beam section 134 is pivotally attached by pin 140 to vertical frame member opening 142, and beam section 136 is pivotally attached by pin 144 to vertical frame member opening 146. Pin 140 is secured to the approximate center of beam 134, and pin 144 is secured to the approximate center of beam 136 in the same manner as shown for pin 62 in FIGS. 4 and 5. Openings 142 and 146 in a vertical frame member 148 of frame 150 are illustrated in FIG. 8 and are spaced to allow the beams to rotate and abut as shown. They are dimensioned such that beam section 136 is just above ground with the bed 12 of trailer 10 level.

For splitting operation, beam sections 134 and 136 are secured together as shown in FIG. 9. Three lateral openings (not shown) in each beam are overlaid by like plates 152, one on each side of beams 134 and 136, each plate having six openings which are arranged to match the beam openings. Then bolt and nut assemblies 154 are employed with respect to each hole and through the plates and beams. a storage and transportation mode requires the disassembly of nut and bolt assemblies 154 and the removal of plates 152. Then, beam sections 134 and 136 are rotated to the position shown in FIG. 10. Here, beam sections 134 and 136 are held in place by nut and bolt assemblies 156 through beam tabs 158 and frame members 160 and 162, respectively, as shown.

To examine typical operation of splitting assembly 133, it will be assumed that beam sections 134 and 136 are initially in their stored position as shown in FIG. 10. First, beam sections 134 and 136 are loosened by removing nut and bolt assemblies 156 (FIG. 10). Beam sections 134 and 136 are then rotated to the vertical position shown in FIG. 8 and locked into alignment by nut and bolt assemblies 154 and plates 152 as illustrated in FIG. 9. Log splitting is then accomplished in the same manner as described above for the first emnbodiment except that splitting wedge assembly 139 essentially travels and is guided by beam sections 134 and 136 as it splits a log placed on anvil 164. When splitting is completed, splitting assembly 133 is disasembled as described above, and beam sections 134 and 136 are rotated to the stowage or storage position shown in FIG. 10 where they are held in place by nut and bolt assemblies 156 and beam tabs 158 as described. As in the first embodiment, in the stowage position, splitting assembly 133 has no elements which protude as to interfere with its transport.

From the foregoing, it is believed clear that the present invention provides an excellent solution to major problems associated with harvesting of firewood. It enables convenient non-interfering transportion of both a splitting assembly, its power source, and transportion of split logs. It reduces the operations that one normally has to accomplish with wood handling and equipment operation and the equipment is relatively inexpensive and simple to operate.

What is claimed is:

1. A wood splitter comprising:

a trailer including a bed, at least one pair of wheels for supporting said bed, and a frame support positioned at one end, a rear end, of said bed;

a generally vertical rectangular frame mountable on said frame support;

a splitting wedge;

elongated guide means for supporting and providing a linear path for said splitting wedge;

pivot means for pivotally attaching said guide means on said rectangular frame;

hydraulic power means including a double-acting hydraulic cylinder supported by an end region of said elongated guide means for forcing said splitting wedge along said guide means;

stop means supported at an opposide end of said elongated guide means for holding wood;

power control means for selectively supplying hydraulic fluid to said hydraulic power means; and holding means for alternately securing said elongated guide means in angularly displaced operating and storage positions enabled by said pivot means.

2. A wood splitter as recited in claim 1 wherein;

said elongated guide means comprises an elongated "H" beam; and said pivot means is attached between an approximate longitudinal center of said beam and an approximate rectangular center of said rectangular frame.

3. A wood splitter as set forth in claim 2 wherein said wood splitter further comprises:

a second frame extending upward from said bed at a front end of said trailer;

means for providing a source of compressed hydraulic fluid, and said source being supported on said second frame; and fluid lines coupling said source of compressed hydraulic fluid and said power control means.

4. A wood splitter as set forth in claim 1 wherein said guide means comprises two "H" beams, and said pivot means comprises first and second pivots separately supporting said beam on said frame and enabling said beams to be rotated between spaced, substantially parallel, positions and an aligned vertical position.

5. A wood splitter as set forth in claim 4 wherein said wood splitter further comprises:

a second frame extending upward from said bed at a front end of said trailer;

means for providing a source of compressed hydraulic fluid, and said source being supported on said second frame; and fluid lines coupling said source of compressed hydraulic fluid to said power control means.

* * * * *